United States Patent [19]

Kunreuther

[11] 4,235,161

[45] Nov. 25, 1980

[54] AUTOMATIC TAG ATTACHING APPARATUS

[75] Inventor: Steven Kunreuther, New York, N.Y.

[73] Assignee: Kunreuther & Beringhause, Carle Place, N.Y.

[21] Appl. No.: 7,259

[22] Filed: Jan. 29, 1979

[51] Int. Cl.[3] ..... B31F 5/00

[52] U.S. Cl. ..... 493/376; 227/28

[58] Field of Search ..... 93/87, 88, 89–92; 227/40, 25, 50, 39, 28, 29

[56] References Cited

U.S. PATENT DOCUMENTS

| | | | |
|---|---|---|---|
| 958,056 | 5/1910 | Woodward | 227/28 X |
| 3,103,666 | 9/1963 | Bone | 1/301 |
| 3,265,274 | 8/1966 | Burnell | 227/50 X |
| 3,564,983 | 2/1971 | Grimm et al. | 93/88 |
| 3,598,025 | 8/1971 | Cotton | 93/87 |
| 3,896,713 | 7/1975 | Mato | 93/88 |
| 3,985,067 | 10/1976 | Livid et al. | 93/88 |

*Primary Examiner*—James F. Coan

*Attorney, Agent, or Firm*—James & Franklin

[57] ABSTRACT

A conventional fastener attacher is vertically mounted to a support in a fixed position relative thereto in a manner which permits pneumatic actuation thereof. A carriage, which is movable along an upstanding guide mounted on the support, has mounted thereon a pneumatically actuated tag feed mechanism. When actuated, the mechanism feeds a tag from a position out of alignment with the axis of the needle of the attacher to a position in alignment with the axis of the needle. Thereafter, the carriage is moved toward the attacher, in a direction substantially parallel to the axis of the needle, to place the fed tag on the needle. In one embodiment, a second carriage, movable along a second upstanding guide, carries a hook feed mechanism which, when actuated, feeds a hook to a position spaced from, but in alignment with the needle. The article to which the tag and hook are to be attached is held between the needle and the hook. The second carriage is actuated to place the hook and, thus, the article on the needle and the attacher is then actuated to dispense a fastener to attach the tag and hook to opposite sides of the article. In a second embodiment, the second carriage has a second tag feeder mounted thereon instead of the hook feeder. The second tag is positioned on the needle prior to actuation of the attacher, such that multiple tags may be attached to the article in a single automatic operation.

55 Claims, 22 Drawing Figures

FIG. 13
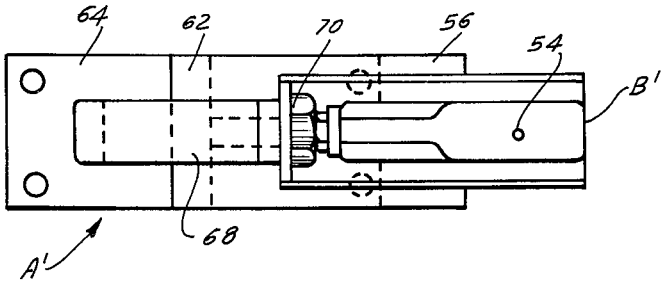
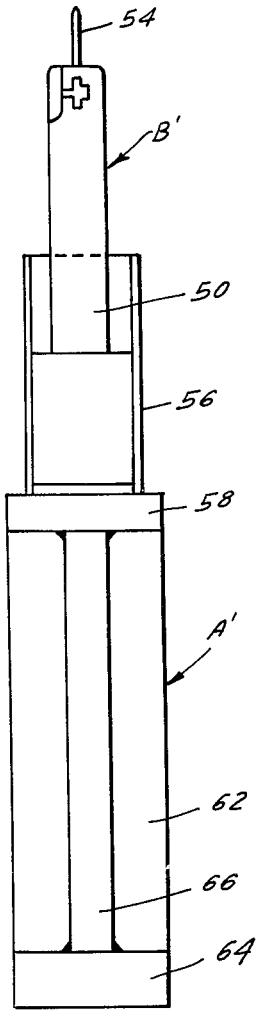
FIG. 12

AUTOMATIC TAG ATTACHING APPARATUS

The present invention relates to tag attaching apparatus and, more particularly, to an automatic tag attaching apparatus wherein the attacher is held in a stationary position and tags and/or hooks are positioned on the needle and wherein multiple tags may be attached to an article in a single operation.

Various industries require that tags and/or hooks be attached to merchandise prior to sale. For instance, in the retail wearing apparel industry, millions of garments are routinely provided with tags which contain information concerning pricing, inventory control and the like. Because of the great quantity of articles which must be tagged in this fashion, it is necessary that the tagging operation be performed as inexpensively as possible. Further, the tag must be affixed to the article in such a manner that theft through tag switching is reduced.

The most widely used tag attaching system includes a hand-held tag attacher or gun, into which a clip of plastic tag attachments or fasteners is mounted. Each of the fasteners includes a T-bar and an enlarged paddle connected by a relatively thin plastic filament. Actuation of the attacher causes the T-bar portion of the fastener to be pushed through a hollow needle. Thus, when the needle is inserted through an opening in the article and through a hole in a tag, and the attacher is thereafter actuated, the T-bar end of the fastener will travel through the needle and, thereafter, be situated on one side of the garment, with the paddle end being situated on the other. This system permits a low-cost tag attaching operation, because a minimum of unskilled labor is required and the cost of the plastic fasteners and the gun-type attacher is relatively small. Futher, the tagging operation is accomplished within a few seconds. Security is assured with this type of fastener because the fastener is made of strong plastic which prevents the tag from being removed, except by destruction of the article or tag, or by cutting the filament of the fastener.

Fasteners and attachers of this type are commercially available from Dennison Manufacturing Company of Framingham, Massachusetts and other suppliers, and are widely used throughout this country and many other countries of the world. The attachers are basically of gun-shape and may either be of the pistol grip type or the scissor grip type. Needles for the fasteners come in a variety of different configurations for use with articles of different characteristics, from fine lingerie to leather shoes.

Attachers of this type are primarily designed for hand-held use and the great majority of attachers utilized today are used in this manner. The very large number of tag attaching operations which take place on a daily basis would indicate the desirability for automating the tag attaching operation. However, while there have been a limited number of attempts to fashion equipment which could be used in conjunction with conventional attachers of the type described in order to automate the tag attaching operation, none of the tag attaching equipment presently available has proven commercially acceptable on any large scale.

There are various reasons for the commercial unacceptability of available automatic tag attaching equipment. One reason relates to the fact that this equipment is designed in a way which does not permit the operator to accurately position the tag and article with respect to the attacher needle to insure that the fastener will penetrate the article in the desired location. A second reason relates to the fact that available equipment is designed to attach only a single tag to the article and, therefore, is useless in applications which require multiple tags or a tag and a hook to be affixed to an article with the same fastener.

Most of the existing automatic tag attaching equipment utilize a carriage, upon which the attaching gun is mounted, which is movable with respect to a stationary support surface. An automatic tag feeding mechanism is provided on the support surface which feeds a tag to a position spaced from the needle but in alignment with the axis thereof. The article to be tagged is then placed, by the operator, between the needle and the tag. The carriage moving mechanism is then actuated to move the attacher towards a stationary support surface, such that the needle penetrates the tag and article. Once the needle has at least partially penetrated the tag and the article, the attacher is actuated to dispense a fastener and the direction of carriage movement is reversed to withdraw the needle. Examples of this type of automatic tag attaching machine are disclosed in Mato U.S. Pat. No. 3,896,713 and Cotton U.S. Pat. No. 3,598,025.

One of the problems with this type of automatic tag attaching equipment, which employs a tag attacher which is moved relative to the tag and article, is that the operator cannot position the article with sufficient accuracy to assure that the fastener will penetrate the article at the precise location on the article which is desired. This is due to the fact that when the article is positioned for the attaching operation, the needle of the attacher is remote therefrom and, in some apparatus, hidden thereby. Therefore, the operator has to approximate the exact location on the article where the needle will penetrate. This is a significant drawback where the fastener must be located along a particular seam or through a pre-existing opening in the article, which is often the case if damage to the article is to be avoided.

Moreover, machines of this type are designed only to feed a single tag per tag attaching operation. However, in certain instances, it is necessary that multiple tags or a tag and a hook be attached in a single operation. In such instances, the commercially available automatic tag attaching equipment either cannot be used or must be used repeatedly, with the same article, to place multiple tags thereon with multiple fasteners in multiple separate operations.

Another drawback of this type of equipment relates to the danger involved in having an attacher with a sharp needle which is abruptly moved automatically with respect to a support surface. The attacher moving mechanism might be actuated at a time when the operator has his hand in the path of movement of the needle. Since the needle is quite sharp, the accidental placement of the operator's hand in the wrong position during the tagging operation would result in an injury. Further, the combination of a fast moving needle and a moving fastener often creates an enlarged hole in the material of the article as same is tagged and may, therefore, be destructive to the article. This is particularly true if the attacher is actuated prior to full penetration of the needle in the article because of the simultaneous movement of the needle and the fastener.

A further drawback relates to the lack of versatility of the apparatus. The tag feeders, designed for use in the commercially available automatic tag attaching equipment, are designed to accommodate tags of a single size and thickness. If tags of different sizes and thicknesses are to be accommodated, significant structural modifications must be performed on the apparatus. Such modifications contribute substantially to the cost of the tagging operation because of the machine downtime required to modify the apparatus to accept tags of different sizes and thicknesses.

Another disadvantage of the commercially available automatic tag attaching equipment relates to the fact that the holes in the tags, through which the needle must pass, are often not precisely positioned in the same location for each tag when the tags are manufactured. Thus, when the tags are fed to a position in the path of movement of the needle, the hole therein may not exactly align with the axis of the needle due to variations in the tag manufacturing process. However, the position to which the tag is fed in these machines cannot be varied and, thus, variations in the position of the hole in tags of the same size or the use of tags of different sizes with the hole in a different location, results in an interruption in the operation of the equipment.

It is, therefore, a prime object of the present invention to provide automatic tag attaching apparatus wherein the operator can accurately determine the precise location on the article of fastener penetration.

It is a second object of the present invention to provide an automatic tag attaching apparatus wherein multiple tags, or a tag and a hook, may be attached to an article in a single operation.

It is a third object of the present invention to provide an automatic tag attaching apparatus wherein the use of a stationary attacher reduces the possibility of creating an enlarged opening in the material of the article.

It is a fourth object of the present invention to provide an automatic tag attaching apparatus wherein the use of a stationary attacher reduces the danger of injury to the operator.

It is a further object of the present invention to provide an automatic tag attaching apparatus which can accommodate tags of varying sizes without requiring significant modification of the structure of the apparatus.

It is another object of the present invention to provide an automatic tag attaching apparatus wherein positive pressure is provided to position the tag on the needle, such that the tag will be positioned on the needle, even absent a hole or if the hole therein is not in its proper location.

It is still another object of the present invention to provide an automatic tag feeding apparatus designed to operate in conjunction with commercially available tag attachers of the trigger-grip and scissor-grip types.

It is a still further object of the present invention to provide an automatic tag attaching apparatus comprising reliably functioning parts, which is relatively inexpensive to manufacture and maintain and which is economical to operate.

In accordance with the present invention, automatic tag attaching apparatus is provided for use in conjunction with a fastener attacher of the type having a hollow needle, through which a fastener is dispensed when the attacher is actuated. The apparatus comprises a support, a means for mounting the attacher to the support in a fixed position relative thereto, means for actuating the attacher, and means for positioning a first member, such as a tag, on the needle. The positioning means comprises a carriage and a means for moving the carriage relative to the support. The carriage comprises means for feeding a member from a first position, out of alignment with the needle, to a second position, in alignment with the needle, and means for actuating the member feeding means.

The carriage moving means moves the carriage along an upstanding guide in a direction substantially parallel to the axis of the needle. The member feeding means moves the member in a direction substantially perpendicular to the axis of the needle. The combination of these two movements permits the tag to be first fed to a position which is in alignment with the axis of the needle, but spaced therefrom. Subsequent movement of the carriage in a direction towards the attacher positively positions the tag on the needle by forcing same over the needle.

Carriage movement, actuation of the tag feed mechanism, and attacher actuation are all preferably achieved by conventional pneumatic cylinders, fed from a source of compressed air. Application of the compressed air to the cylinders, respectively, is controlled by a plurality of electrically actuated solenoid valves which are responsive to a control means comprising footpedal actuated relay circuitry.

The control means causes the tag to be fed and positioned over the needle prior to the actuation of the attacher. The carriage to which the tag feed mechanism is mounted is first caused to move in a direction parallel to the axis of the needle to a position which is relatively remote from the attacher. The control means then actuates the tag feed mechanism to feed a tag to a position in alignment with the needle and the carriage is caused to move downwardly towards the attacher, such that the fed tag is positioned on the needle.

The attacher further preferably comprises means for positioning a second member, in the form of a tag or hook, over the needle. The second member positioning means includes a second carriage and means for moving the second carriage relative to the support. The second carriage has mounted thereon means for feeding a second member from a first position, out of alignment with the needle, to a second position, in alignment with the needle, and means for actuating the second member feeding means.

When the second member is in the form of a hook, the second carriage also includes a member extending from the second carriage and having a substantially planar surface with a recess therein. The recess is aligned with and adapted to receive therein at least a part of the attacher needle. The second carriage is movable by means of a pneumatic cylinder between a first position, wherein the abutting surface is remote from the needle, and a second position, wherein the needle is at least partially received within the recess. The second member feeding means is designed to feed the second member adjacent to the surface, such that it is located between the surface and the needle. In this position, the hole (if present) situated within the second member is aligned with the recess.

After the second member feeding means has been actuated by a pneumatic cylinder, controlled by the control circuitry, and the article to which the members are to be attached is inserted between the needle and the second member, the air cylinder controlling the movement of the second carriage is actuated to move the second carriage downwardly towards the attacher. As this takes place, the article and the second member are positioned on the needle, with the needle at least partially received in the recess. The control circuitry then energizes the pneumatic cylinder which actuates the attacher and a fastener is fed from the clip of fasteners, such that the T-bar end thereof passes through the hollow needle to attach the first and second members to the article. If the second member is in the form of a hook, the second carriage is moved upwardly away from the needle and the article is then removed from the needle by the operator.

The second member may be in the form of a tag or a plastic hook. In the first embodiment of the present invention, the second carriage has mounted thereon a hook feeding mechanism. In the second preferred embodiment of the present invention, the second carriage has mounted thereon a tag feeding mechanism. In the first embodiment, the tag and hook are placed on opposite sides of the article. In the second perferred embodiment, the two tags may be placed on the same side or opposite sides of the article, as is desired, by modifying the sequence of operations.

The present invention should be construed to include an apparatus without the second carriage portion of the apparatus, as well as an apparatus with this feature. When used without the second carriage portion of the apparatus, the invention has three major advantages over the prior art. First, the tag is positively forced down on the needle, thus premitting the tag to be placed on the needle even if the tag has no hole therein or if the hole is misaligned with the needle. This is because the tag is firmly held between a portion of the tag feed mechanism and a portion of the first carriage at a position adjacent the axis of the needle. Thus, when the first carriage is moved down, the tag is forced on the needle, whether or not the hole (if present) is properly aligned with the needle.

Second, the position of the tag on the needle is visible to the operator before the article to be tagged is positioned to obscure same. Thus, if for some reason the tag is not properly positioned on the needle, the operator is aware of this defect before the fastener is positioned. Thus, the operator may manually adjust the tag position or put a new tag on the needle before actuating the attacher.

Third, the operator can see exactly where the needle has penetrated the article prior to actuation of the attacher. Thus, if the location of penetration is unsuitable, the article is simply lifted and again put on the needle.

When the present invention is used with the second carriage portion of the apparatus, with or without the second member feeding means, the invention has the above stated advantages and the following additional advantage of permitting the operator to have his hands at a position remote from the needle when the second carriage downward movement is initiated. This is because a portion of the second carriage will abut the top side of the article and push same on the needle automatically, if same has not been placed on the needle by the operator. This is a significant safety feature, obviously not required when no second carriage is present.

To these and other objects as they may hereinafter appear, the present invention relates to an automatic tag attaching apparatus, as described in the following specification and set forth in the annexed claims, taken together with the accompanying drawings, wherein like numerals refer to like parts, and in which:

FIG. 12 is a front view of the attacher actuator mechanism of FIG. 11;

FIG. 13 is a top view of the attacher actuator mechanism shown in FIG. 11;

Figure 1:
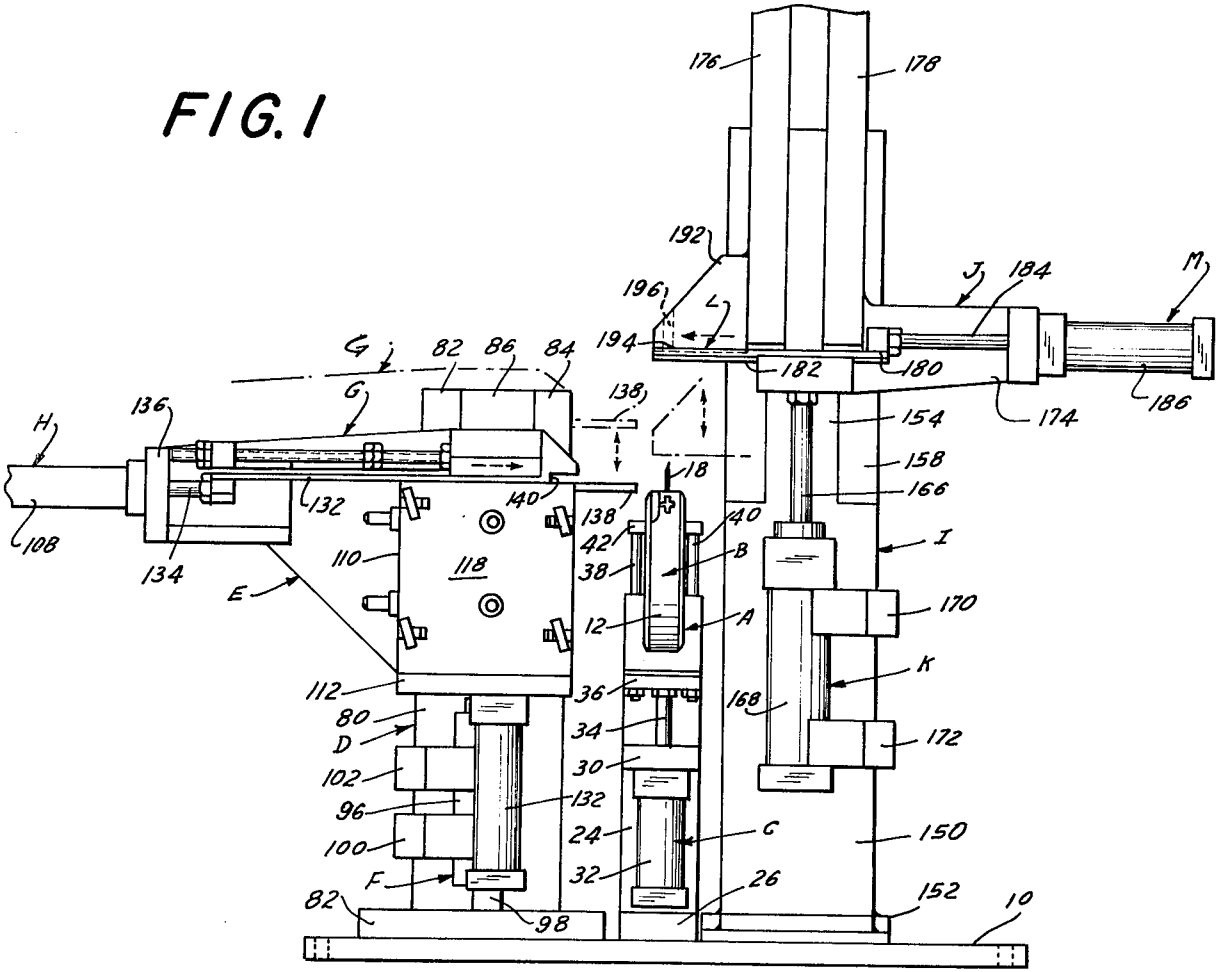
FIG. 1 is a front elevational view of a first preferred embodiment of the present invention.

FIG. 1 illustrates a first preferred embodiment of the present invention. As shown in FIG. 1, the first preferred embodiment of the present invention comprises a means, generally designated A, for fixedly mounting a fastener attacher, generally designated B, to a support in a manner which prevents relative movement therebetween. Attacher B is of the commercially available type which has a hollow needle adapted to be inserted through an article and through which a fastener is dispensed when the attacher is actuated. Means, generally designated C, are provided for actuating the actuator when energized.

Alongside attacher mounting means A is located a means, generally designated D, for positioning a member (a tag or the like) on the needle of attacher B. The positioning means comprises a carriage, generally designated E, and a means, generally designated F, for moving the carriage relative to the support in a direction generally parallel to the axis of the needle of attacher B. Carriage E comprises means, generally designated G, for feeding a tag in a direction generally perpendicular to the axis of the needle of attacher B from a first position, out of alignment with the needle, to a second position, in alignment with the needle. Means, generally designated H, are provided on carriage E for actuating the tag feeding means G.

Located along the other side of actuator mounting means A, is a second member (hook) positioning means, generally designated I. Hook positioning means I comprises a second carriage, generally designated J. Means, generally designated K, are provided for moving the second carriage relative to the support in a direction parallel to the axis of the needle of attacher B. Carriage J comprises means, generally designated L, for feeding a hook in a direction substantially perpendicular to the axis of the needle from a first position, out of alignment with the needle, to a second position, in alignment with the needle. Means, generally designated M, are provided for actuating the hook feed means L. The attacher mounting means A, the tag positioning means D, and the hook positioning means I, are each mounted on a substantially planar support 10.

Figure 5:
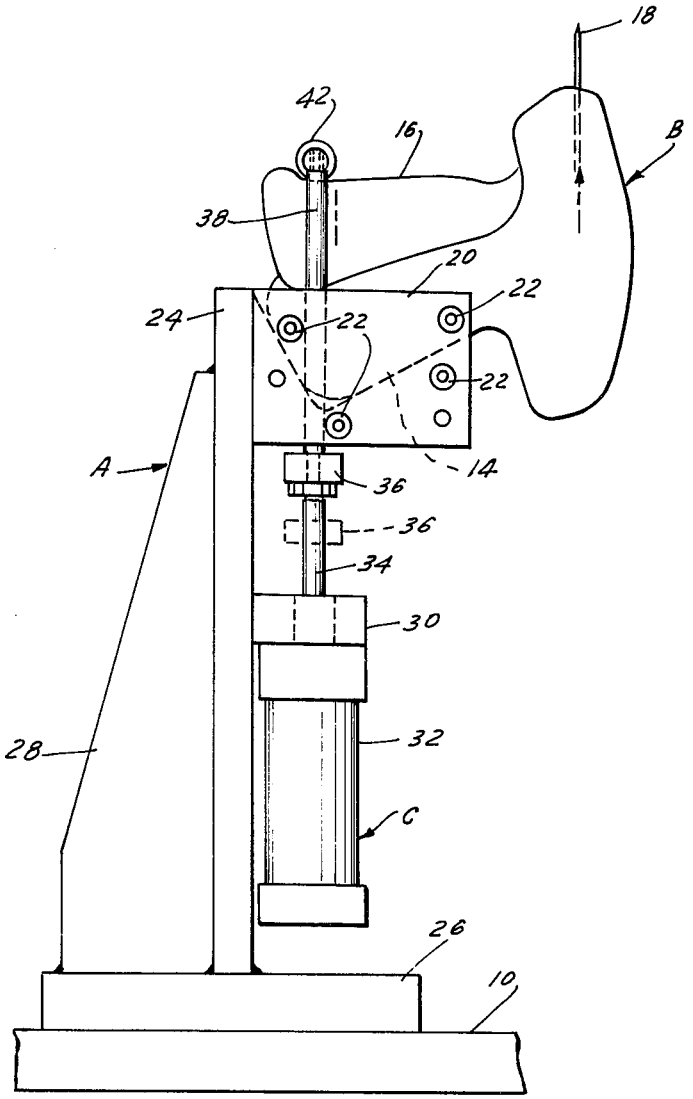
FIG. 5 is a side view of an attacher actuator mechanism, designed for use with a trigger-type gun in the first preferred form of the present invention.
Figure 7:
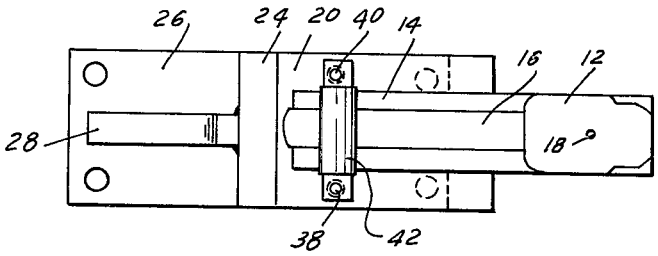
FIG. 7 is a top view of the attacher actuator mechanism of FIG. 5.
Figure 6:
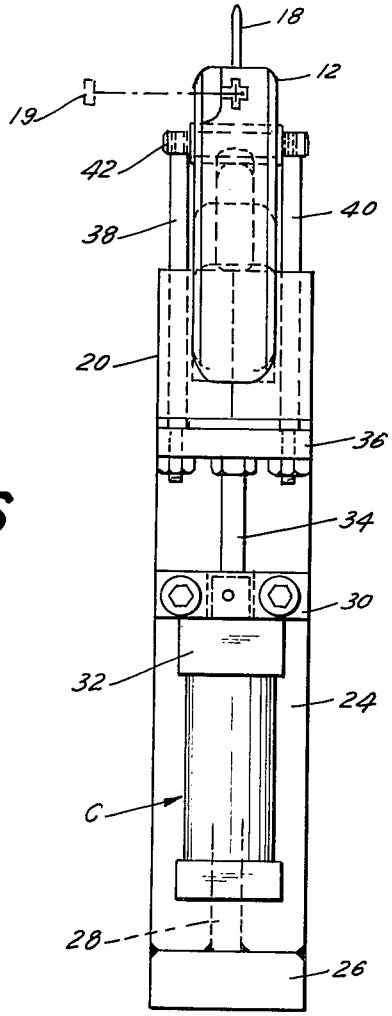
FIG. 6 is a front view of the attacher actuator mechanism shown in FIG. 5.

FIGS. 5, 6 and 7 illustrate one embodiment of the attacher support means A adapted for use with a trigger-type fastener dispensing attacher 12. Attacher 12 has a handle portion 14 and a trigger portion 16. Trigger portion 16 may be moved partially into a recess (not shown) in handle portion 14 so as to actuate the attacher to dispense a fastener 19 (FIG. 6) through hollow needle 18. Attacher 12 is a commercially available pistol grip type attacher such as is sold by Ben Clements & Sons under the trademark TACH-IT, or any similar piston grip type attacher.

Handle 14 is firmly secured to a bracket 20 by means of screws 22 or the like. Bracket 20 is mounted on an upstanding support 24 which extends from a base 26 which, in turn, is secured to the upper surface of support 10 by means of screws or the like. A rearwardly extending member 28 is attached to the rear surface of support 24 and the upper surface of the rear portion of base 26, so as to impart additional rigidity to the attacher mounting structure. As can be readily appreciated, the attacher mounting means A is designed to fixedly mount an attacher B on support 10 in a manner which prevents the relative movement therebetween, such that attacher B and needle 18 extending therefrom are always in a stationary position with respect to support 10.

Extending from the forward surface of support 24, in a direction substantially parallel to base 26, is a cylinder mounting bracket 30 to which a cylinder 32 is fixedly mounted. Cylinder 32 has an extendible piston rod 34 which passes through an opening in bracket 30 and is movable in a direction substantially parallel to the plane of support 24. At the end of piston rod 34 is mounted a trigger engaging structure comprising a lower horizontal member 36, a pair of vertically extending members 38, 40 and a generally cylindrical upper member 42. Vertically extending members 38 and 40 are situated in recesses on the opposite sides of bracket 20 to permit movement of same without interference from the bracket.

The handle engaging structure comprising members 36, 38, 40 and 42 is normally in a position spaced a maximum distance from cylinder support bracket 30 and is, thus, in the position shown in solid in FIG. 5. However, when pneumatic cylinder 32 is actuated by connecting same to a source of compressed air, rod 34 and, thus, the handle engaging structure, are moved downwardly, towards the top surface of cylinder mounting bracket 30 as is shown partially in phantom in FIG. 5. When this occurs, trigger 16 is moved downwardly into handle 14 of attacher B to actuate attacher B to dispense a fastener through needle 18. After attacher B has been actuated, the trigger 16, which is spring loaded towards the normal position (shown in FIG. 5), returns to that position. The spring loading of trigger 16 also causes the trigger engaging structure, rod 34 and the cylinder within piston 32 to return to its normal position. The spring which accomplishes this return movement is located within handle 14 and not shown.

Figure 11:
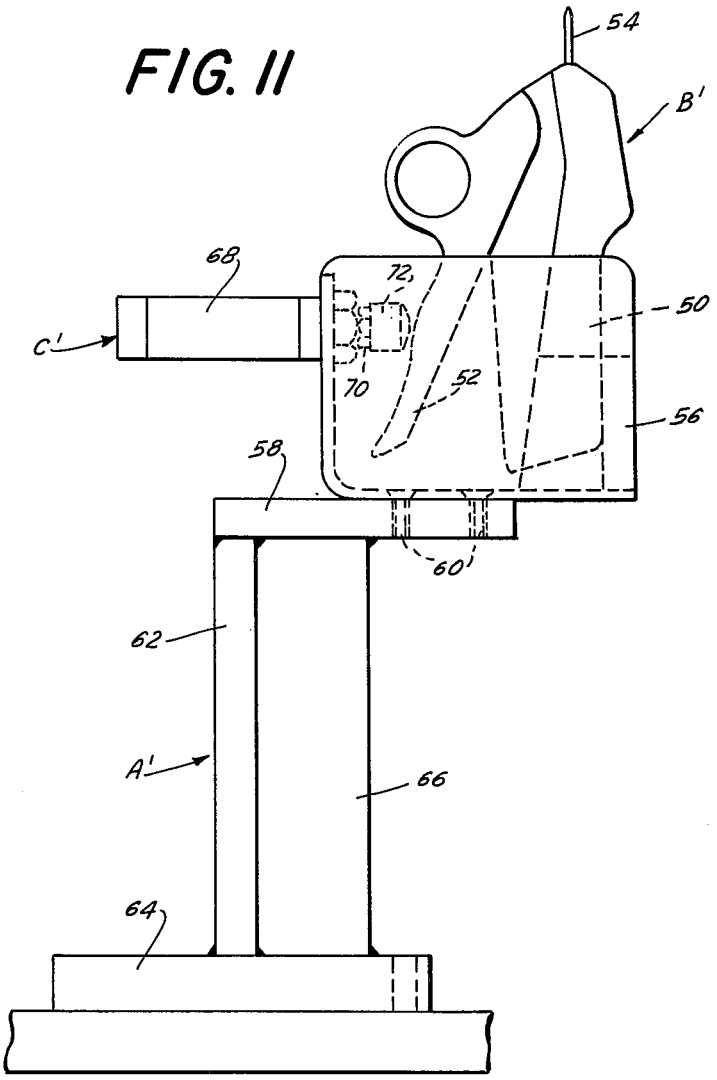
FIG. 11 is a side view of an alternate attacher actuator mechanism, designed for use with a scissor-grip type attacher.

The actuator mounting means may also be designed for use with a scissor-type fastener attacher B′, as is illustrated in FIGS. 11, 12 and 13. Such an attacher is commercially available from the Dennison Manufacturing Company and is sold under the trademark SWIFTACHER. In this instance, attacher B′ is actuated with a scissor-like motion wherein part 50 and part 52 are brought together to actuate the attacher to dispense a fastener through hollow needle 54.

In this instance, the attacher mounting means, designated A′, comprises a bracket 56 to which member 50 of attacher B′ is fixedly mounted. Bracket 56 is situated on a horizontal support member 58 and affixed thereto by means of screws 60. Horizontal support member 58 is connected to a vertical support member 62 which, in turn, is situated on a base member 64. Base member 64 is situated on the top surface of support 10 and connected thereto by means of screws and the like. A forwardly extending member 66 is connected between the upper surface of base 64, the forward surface of member 62 and the bottom surface of member 58 to impart additional rigidity to the structure.

Extending rearwardly from the rear surface of bracket 56 is a pneumatic cylinder 68 having an extendible piston rod 70 connected thereto. At the end of rod 70 is an abutting member 72 which is situated adjcent to the lower portion of member 52 of attacher B′. The energization of cylinder 68 causes rod 70 to be extended such that abutting member 72 moves member 52 towards member 50 so as to actuate attacher B′ in a scissor-like fashion. When cylinder 68 is de-energized by disconnecting it from a source of air under pressure, a spring (not shown) which is part of attacher B′ will cause members 52 and 50 to separate such that rod 70 and the piston (not shown) connected thereto move backwardly such that the mechanism returns to the position illustrated.

Figure 2:
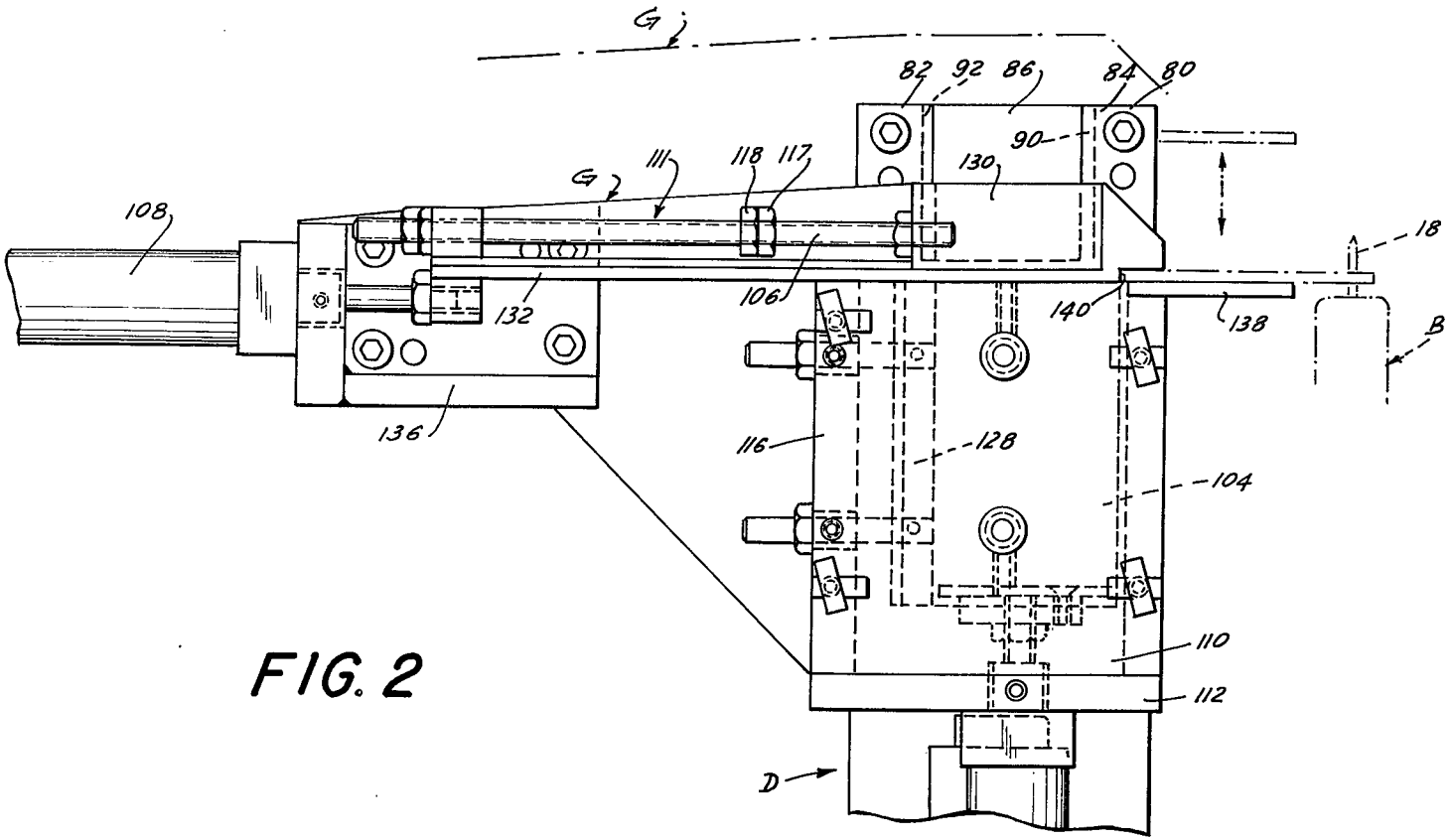
FIG. 2 is a more detailed view of the front of the tag feed mechanism of the first preferred embodiment of the present invention.
Figure 3:
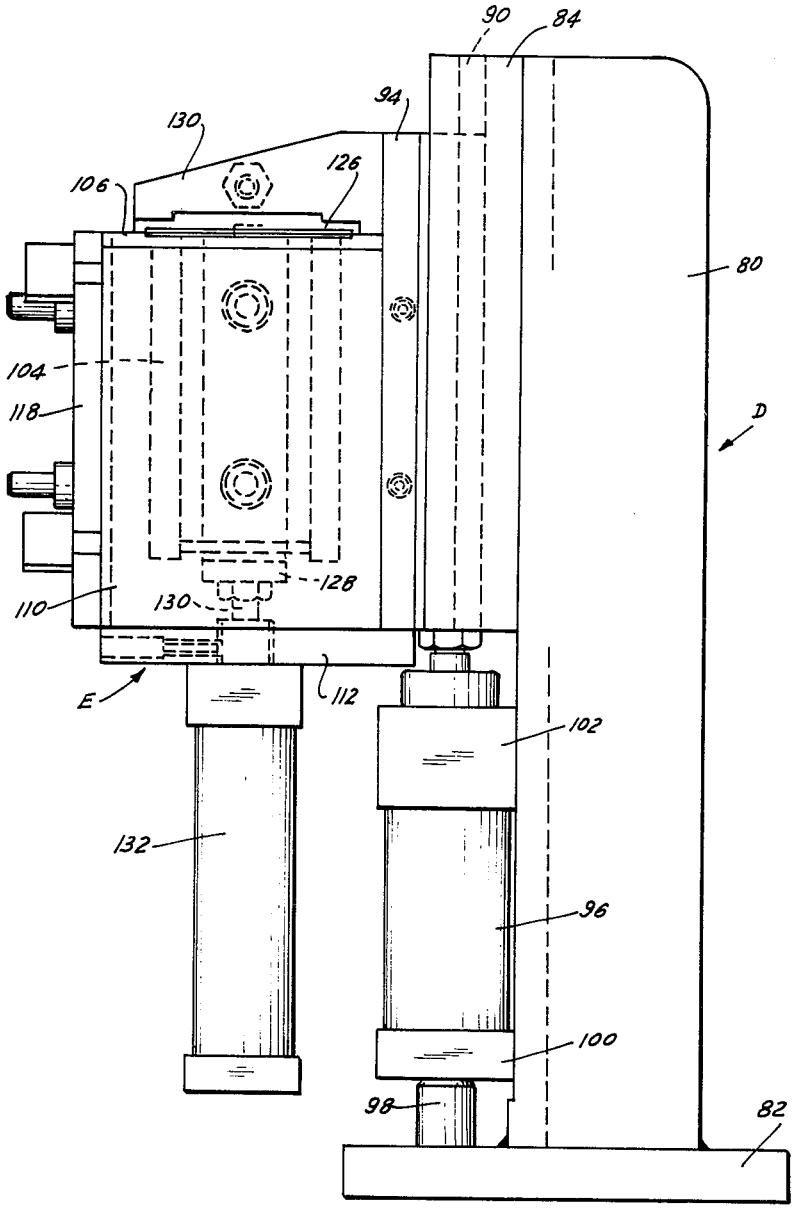
FIG. 3 is a side view of the tag feed mechanism and first carriage of the first preferred form of the present invention, taken along line 3—3 of FIG. 1.
Figure 4:
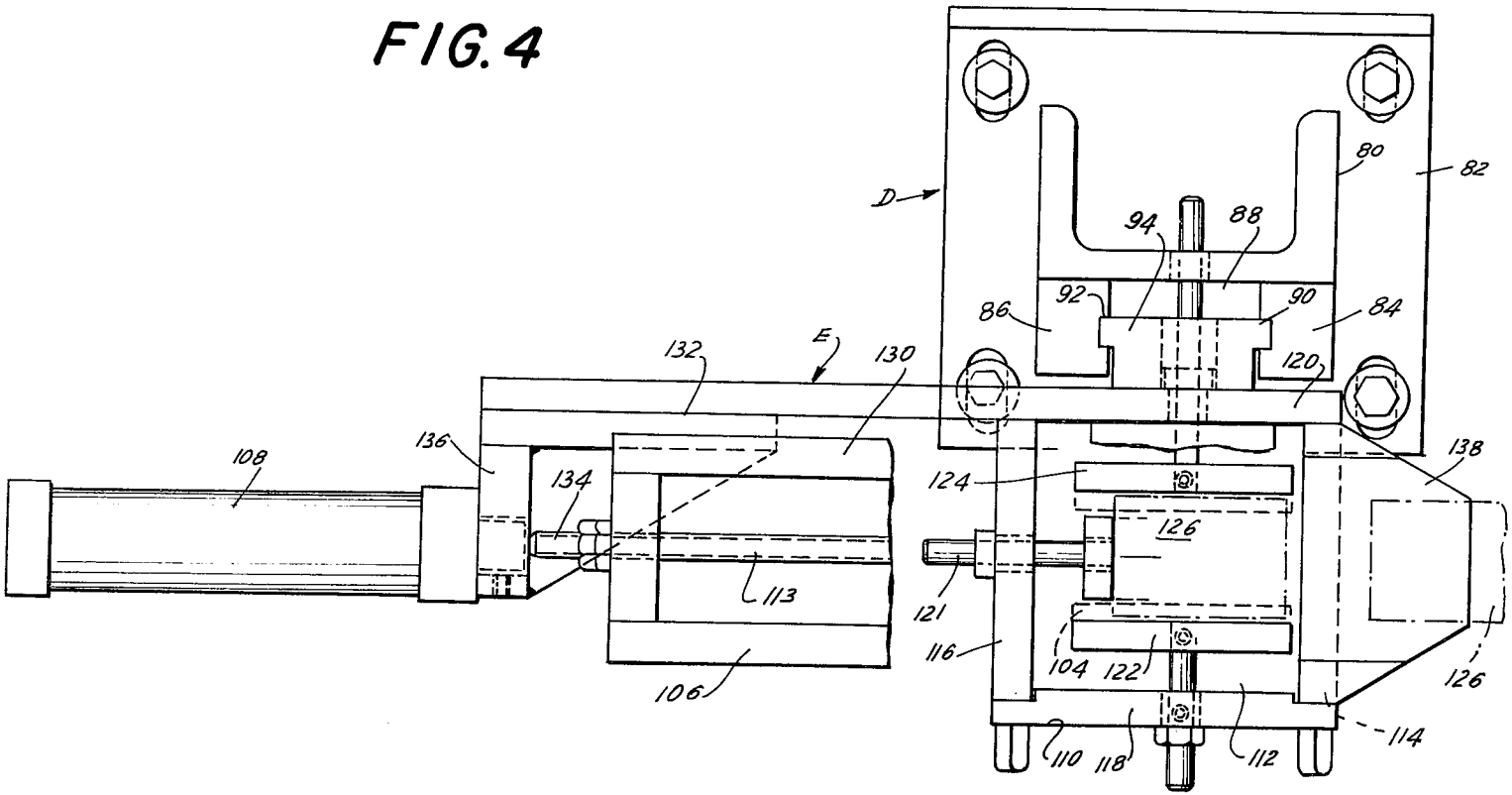
FIG. 4 is a top view of the tag feed mechanism and carriage of the first preferred embodiment of the present invention, taken along line 4—4 of FIG. 1.

The details of the first member (tag) positioning means D can best be understood from FIGS. 2, 3 and 4. The tag positioning means D comprises an upstanding support 80 mounted on a horizontal base 82 which, in turn, is mounted to the upper surface of support 10. Upstanding support 80 has a generally U-shaped configuration such that forwardly extending walls 84, 86 define a vertically extending recess 88. Each of the walls 84, 86 is provided with a vertically extending guide groove 90, 92, respectively, into which a carriage support member 94 is movably received. In this manner, carriage support member 94 may move vertically with respect to support 80 along recess 88.

Located below walls 84 and 86, adjacent to the front surface of support 80, is a pneumatic cylinder 96. The bottom of cylinder 96 rests on a pedestal 98 which, in turn, is supported by base 82. Brackets 100 and 102 serve to mount cylinder 96 to upstanding support 80. An extendible piston rod (not shown) extends from the top of cylinder 96. The end of this extendible piston rod is mounted on the underside of carriage support bracket 94.

Cylinder 96 serves to move carriage mounting bracket 94 and, thus, carriage E, vertically with respect to upstanding support 80 between a first position, as shown in solid in FIG. 2, and a second position, as shown in phantom in FIG. 2. In this manner, carriage E may be moved with respect to needle 18 of attacher B in a direction substantially parallel to the axis of the needle.

Carriage E comprises a tag storage magazine 104, a tag dispenser 106, and a tag dispenser actuator 108. The tag storage magazine 104 comprises an enclosure 110 having a bottom surface 112, a front surface 114, a rear surface 116 and a pair of side surfaces 118, 120. Enclosure 110 is fixedly mounted to carriage support member 94 such that the carriage E and enclosure 110 are vertically movable along with carriage support member 94.

Extending inwardly from surfaces 116, 118 and 120 are position adjustable guide members 121, 122, 124, respectively. Tags 126 are stacked between guides 121, 122 and 124, the position of which may be adjusted in accordance with the size of the tags. The stack of tags rests on a surface 128 which, in turn, is connected to an extendible piston rod 134 of a pneumatic cylinder 132 which is mounted to the underside of member 112 which forms the bottom of enclosure 110. Pneumatic cylinder 132 is continuously connected to a source of compressed air, such that it exerts an upwardly directed force on the bottom of the stack of tags 126 in a manner similar to a spring. However, the use of a pneumatic cylinder has the advantage that the pressure exerted on the bottom of the stack of tags can easily be adjusted to suit the characteristics of the particular tags utilized.

The tag dispensing mechanism 106 is located immediately above the stack of tags 126 and comprises a slide 130 which is movable along a slide frame 132 in a direction substantially perpendicular to the axis of needle 18. Slide 130 includes an adjustable element 111, including a thread shaft 113 and nuts 115, 117, the rotation of which serve to adjust the throw of slide 130. This permits tags with holes in different positions, or tags of different sizes, to be accommodated. Slide 130 is moved along frame 132 by means of pneumatic cylinder 108 which has an extendible piston rod 134. Cylinder 108 is mounted on frame 132 by means of a bracket 136. When cylinder 108 is energized towards the feed position by connecting same to a source of compressed air, rod 134 is caused to move towards the right, as seen in FIGS. 2 and 4, thereby causing slide 130 to slide along frame 132 in the same direction. The movement of slide 130 will cause the top tag from the stack to move to a position overhanging a horizontally extending tag support 138, such that same is aligned with the axis of needle 18. In this position, the tag is clamped between the forward portion of the slide and support 138 so as to prevent the tag from flexing upwardly as same is placed on the needle. The movement of tag 126 is caused by a recess 140 which forms a part of the forward portion of slide 130. Thus, the actuation of cylinder 108 towards the "feed" position will cause the top tag 126 on the stack to move from a position aligned with the stack to a position overhanging guide 138 and clamped thereto. When cylinder 108 is energized towards the "reload" position, slide 130 is moved back to its original position. The next tag 126 on the top of the stack will then be caused, by the force exerted by cylinder 132, to align with slide 130 such that on the next actuation of the slide towards the "feed" position, the tag which is on the top of the stack will be moved to overhang support 138 and be clamped thereto.

As will be described in detail below, the operation of cylinders 96 and 108 may be controlled so as to position a tag 126 on needle 18. For illustrative purposes, the sequence may be considered to begin with the rod of cylinder 96 fully extended such that carriage E is in its uppermost position with respect to upstanding support 80, as is shown in phantom in FIG. 2. At this point, pneumatic cylinder 108 is actuated to move slide 130 along slide frame 132 towards the right (as seen in FIGS. 2 and 4), such that the forward portion of the slide moves the top tag 126 from the stack to a position overhanging support 138 with the tag spaced from the needle but aligned with the axis thereof. Cylinder 96 is then actuated to move carriage E downwardly with respect to upstanding guide 80 such that overhanging tag 126, which is in alignment with the axis of needle 18, is forced on the needle (as is shown in phantom in FIG. 2). Pneumatic cylinder 108 is then actuated to withdraw the slide 130 to its original (reload) position leaving the tag 126 over needle 18 and, thereafter, pneumatic cylinder 96 is again actuated to move carriage E to its uppermost position. This sequence of operations may be repeated, prior to the actuation of attacher B, until several tags are positioned on needle 18, if desired.

Figure 8:
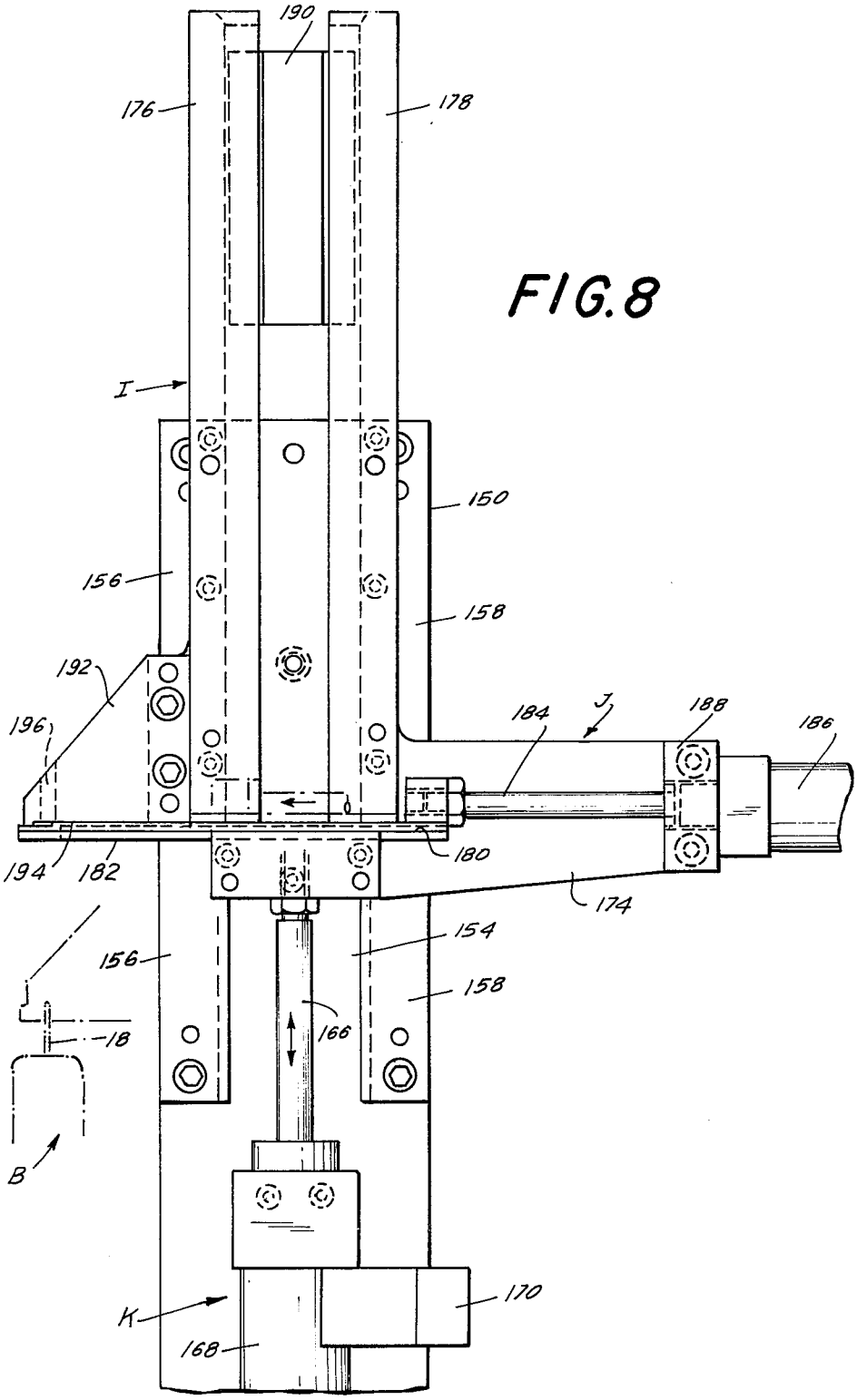
FIG. 8 is a detailed front view of the hook feed mechanism of the first preferred embodiment of the present invention.
Figure 9:
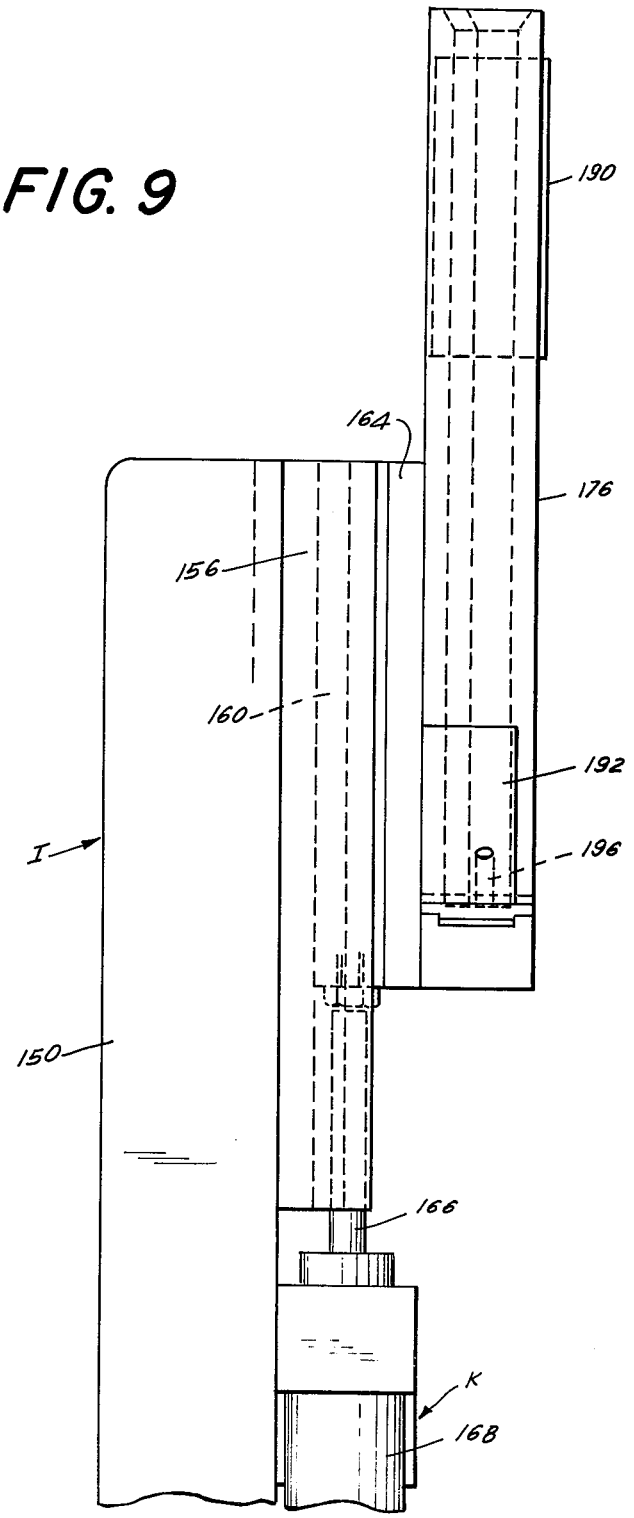
FIG. 9 is a side view of the hook feed mechanism of the first preferred form of the present invention, taken along line 9—9 of FIG. 1.
Figure 10:
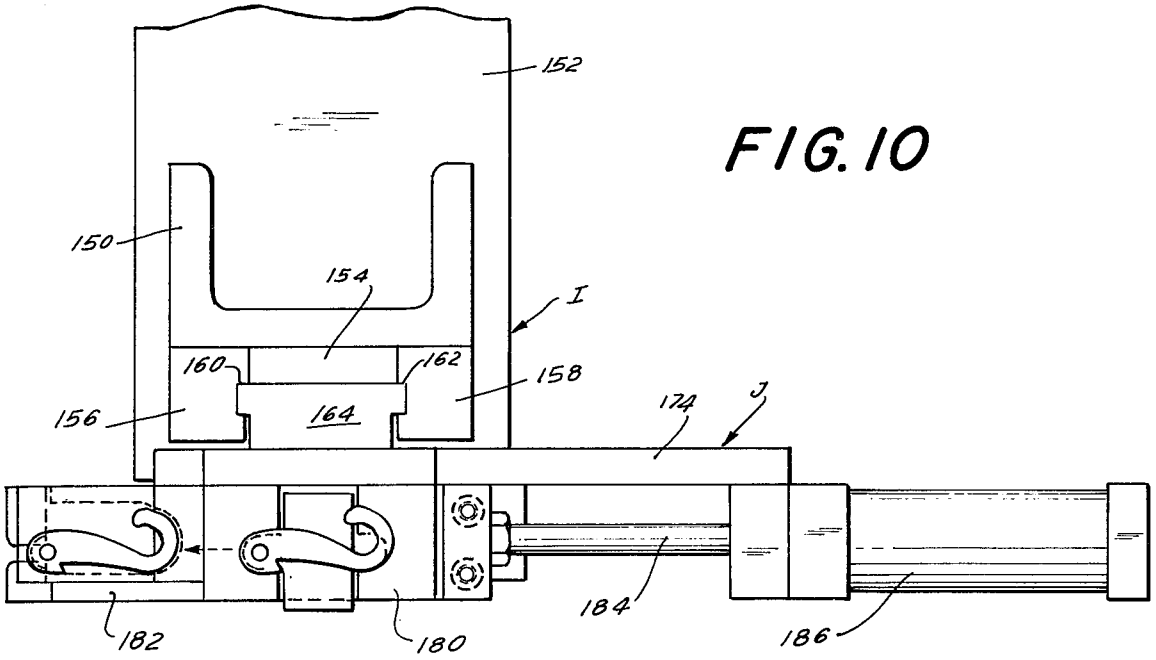
FIG. 10 is a top view of the hook feed mechanism of the first preferred form of the present invention, taken along line 10—10 of FIG. 1.

FIGS. 8, 9 and 10 illustrate the second member (hook) positioning means I. In the first preferred embodiment, the second member positioning means I takes the form of a hook feeder. The hook feeder dispenses, one at a time, a substantially planar hook made of plastic or thin metal which has an aperture hunched therein. Hook positioning mechanism I comprises an upstanding support 150 which is mounted on a horizontal base 152 which, in turn, is affixed to support 10. A portion of upstanding support 150 has a U-shaped configuration, when viewed from the top, as in FIG. 10. A recess 154 is defined between a pair of forwardly extending walls 156, 158, each of which is provided with a guide groove 160, 162, respectively. Within recess 154 is situated a hook feeder support bracket 164 which is received within and freely movable along guide grooves 160 and 162. Mounted to hook feed support bracket 164 is the hook feed mechanism J. The bottom of hook feed mechanism J is supported by an extendible piston rod 166 which extends from the piston of a pneumatic cylinder 168 fixedly mounted to upstanding support 150 by brackets 170, 172. The energization of pneumatic cylinder 168 will cause the hook feed mechanism J to move vertically along upstanding support 150 between a first position, as shown in solid in FIG. 1, and a second position, partially shown in phantom in FIG. 1.

Hook feed mechanism J comprises a base 174 mounted on hook mechanism support member 164 for movement therewith and a hopper defined between a pair of upstanding members 176, 178 which form a recess into which a stack of hooks is placed. At the bottom of the hopper is a horizontally movable slide 180, movable along a slide guide 182. The rear of slide 180 is connected to an extendible piston rod 184 which extends from pneumatic cylinder 186 which, in turn, is mounted to member 174 by means of a bracket 188. Energization of pneumatic cylinder 186 causes slide 180 to move horizontally between a first (reload) position, as shown in solid in FIG. 10, immediately below the stack of hooks to a second (feed) position, as shown in partial phantom in FIG. 10, wherein the bottom hook from the hopper has been moved to a position such that the hole therein is aligned with the axis of needle 18 of attacher B. When the actuation of pneumatic cylinder 186 is reversed, slide 180 returns to its original (reload) position wherein it engages the next hook on the bottom of the stack. Thus, the actuation of pneumatic cylinder 186 will cause slide 180 to dispense a single hook at a time. It should be noted that a member 190 is placed in the hopper on top of the stack of hooks so as to provide sufficient weight such that the bottom hook from the stack is urged towards the slide 180. In this manner, one hook at a time is positioned in alignment with, but remote from, needle 18.

Extending from support 174 is a triangular shaped (when viewed as in FIG. 8) member 192 having an abutting undersurface 194 with a cylindrical recess 196 therein. Recess 196 is located along abutting surface 194 such that it is in alignment with the axis of needle 18. The purpose of member 192 is to impart sufficient rigidity to a hook situated therebelow such that when the hook feed mechanism J is moved downwardly towards needle 18, the article to be tagged, which is placed therebetween, will be forced on needle 18 prior to the positioning of the hook on the needle.

The operation of the hook positioning mechanism I is controlled by the energization of pneumatic cylinders 168 and 186. Pneumatic cylinder 168 is actuated to move the hook feeding mechanism J to its uppermost position with respect to vertical support 150, this position being shown in solid in FIG. 1. Pneumatic cylinder 186 is then actuated to move slide 180 along slide frame 182 so as to displace the hook on the bottom of the stack in the hopper to a position in alignment with the under abutting surface 194 of member 192 with the opening in the hook in alignment with recess 196. After the article is placed between needle 18 and member 192 by the operator, pneumatic cylinder 168 is actuated in the reverse direction to move carriage J to its downwardmost position, as partially shown in phantom in FIG. 1, such that the article and the hook are positioned on needle 18 and needle 18 is at least partially received within recess 196. Once the tag, article and hook are correctly positioned over the needle, the attacher actuating means C is energized such that the fastener is dispensed through the needle.

Figure 14:
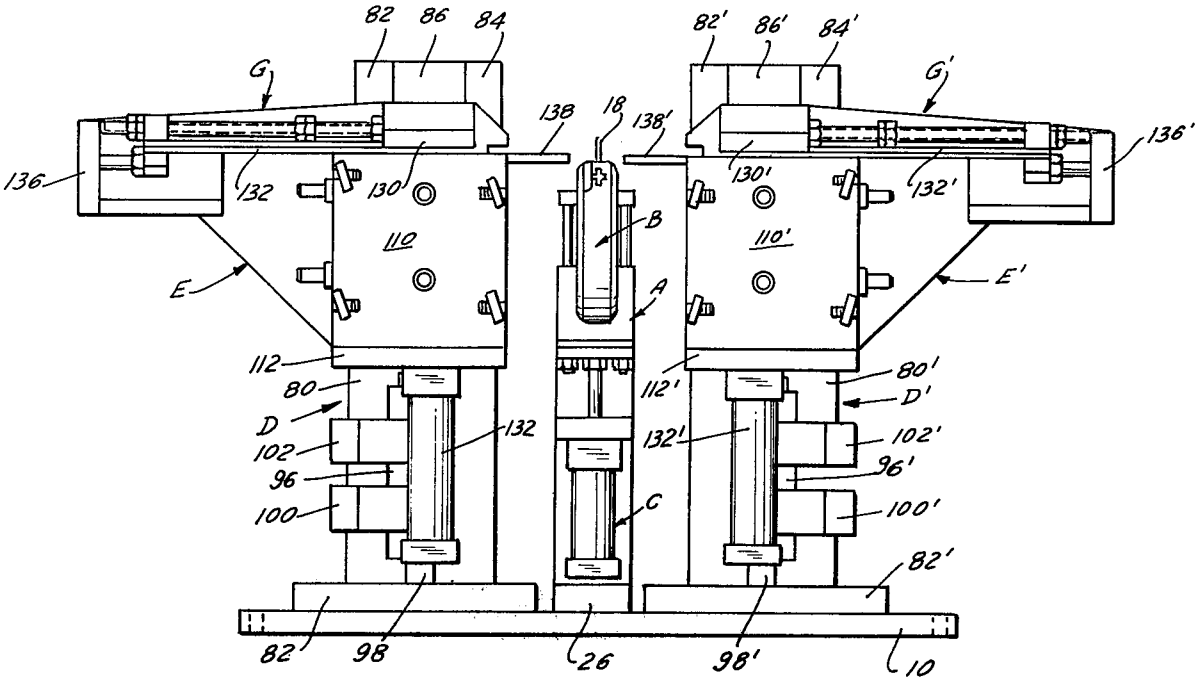
FIG. 14 is a front elevational view of a second preferred embodiment of the present invention.

FIG. 14 shows a second preferred embodiment of the present invention. The second preferred embodiment of the present invention is identical in structure and operation with the first preferred embodiment as described above, except that in the second preferred embodiment, the second member positioning means I is in the form of a second tag positioning means instead of a hook positioning means. The structure and operation of the second tag feeding means is identical to the tag feeding means described above. For this reason, the structure of same is not described in detail. The parts thereof are numbered with the same numbers and letters as the previously described, but with primes to distinguish same. The second preferred embodiment is utilized when multiple tags are required to be affixed to an article in a single attaching operation. The tags may be placed both on one side of the article or on opposite sides of the article, as is desired, by simply altering the sequence of actuation of the appropriate pneumatic cylinders.

Figure 15C:
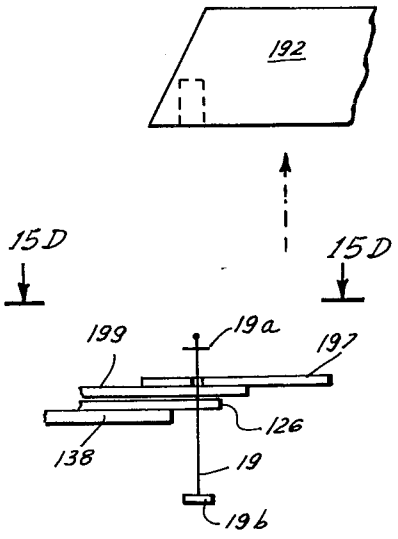
FIGS. 15A–15P are sequential views illustrating a preferred step-by-step sequence of operations of the first preferred embodiment of the present invention.
Figure 15B:
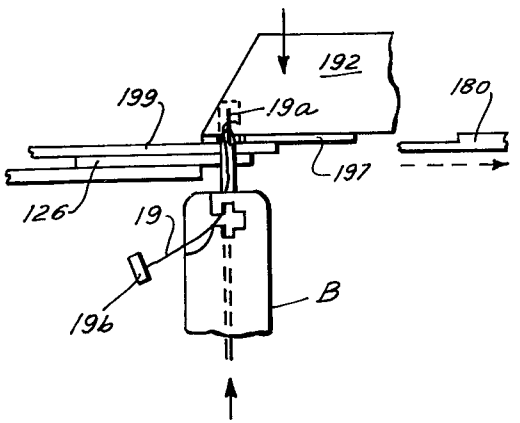
Figure 15A:
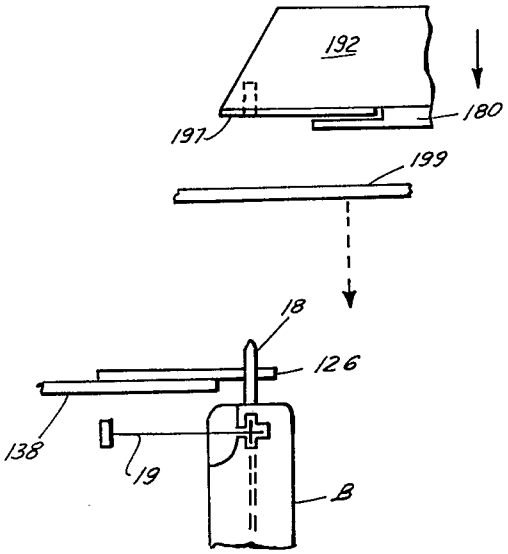

The sequence of operation of the first preferred embodiment of the present invention is schematically illustrated in stepwise fashion in FIGS. 15A through 15F. In FIGS. 15A–15C, an attacher B having a hollow needle 18 and a clip of fasteners 19, such as those commercially available from the Dennison Manufacturing Company under the trademark SUPER SWIFTACH, is illustrated. Attacher B is held stationary with respect to the support structure of the mechanism.

FIG. 15A illustrates the initial position of slide 130 (reload), tag 126 (on needle), slide 180 (feed), hook 197 (aligned with needle), and article 199 to be tagged with respect to stationary attacher B having a needle 18. The sequence of operations begins with tag 126 already on needle 18 and hook 197, in the "feed" position (aligned with the needle) but spaced therefrom. The article 199 is placed by the operator between hook 197 and needle 18.

Actuation of a foot pedal (or other appropriate switch mechanism such as one which requires both of the operator's hands for actuation) control causes carriage J, slide 180 and hook 197 to move downwardly toward the needle such that article 199 is forced on the needle, as is hook 197. Attacher B is then actuated such that the T-bar end **19*a* of fastener 19 is dispensed through hollow needle 18. Simultaneously, the tag feeder slide 180 is moved to the "reload" position. This is illustrated in FIG. 15B. Once out of the needle, T-bar 19*a* moves to a horizontal position. Carriage J and member 192 then move upwardly such that the tag 126, article 199, hook 197 and fastener 19 may then be removed from the needle and will appear as in FIGS. 15C and 15D. The T-bar end 19*a* of fastener 19 is situated on one side of hook 197, the paddle end 19*b* of the fastener is located on the other side of tag 126 and article 199** is situated therebetween. At this point in the sequence, a time delay is built in, such that the tagged and hooked article can be removed from the needle prior to subsequent movement of carriage E to its "down" position.

Figure 15F:
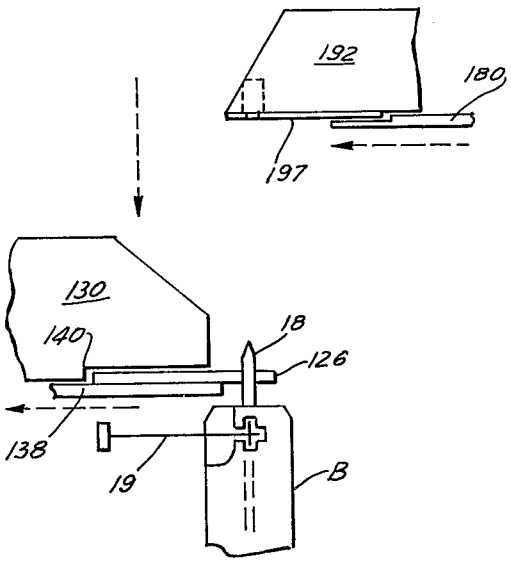
Figure 15E:
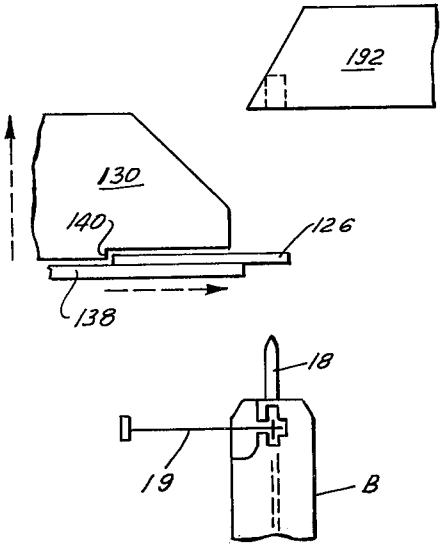
Figure 15D:
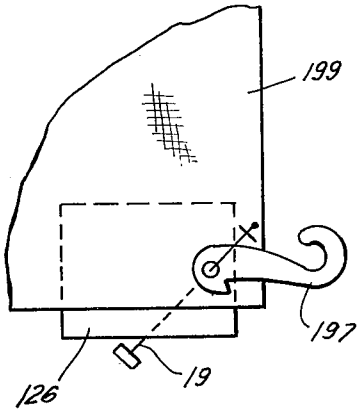

Carriage J is now in the "up" position and carriage E is in the "down" position. Slide 130 is in the "reload" position and slide 180 is still in the "reload" position. As carriage E is moved to its "up" position, the tag feed mechanism (slide 130) is caused to feed a new tag 126 (FIG. 15E). Carriage E is then moved to the "down" position, to place the already fed tag 126 on the needle. Slide 180 is moved to the "feed" position as slide 130 is moved to the "reload" position (FIG. 15F). The cycle is then ready to begin again.

Figure 16:
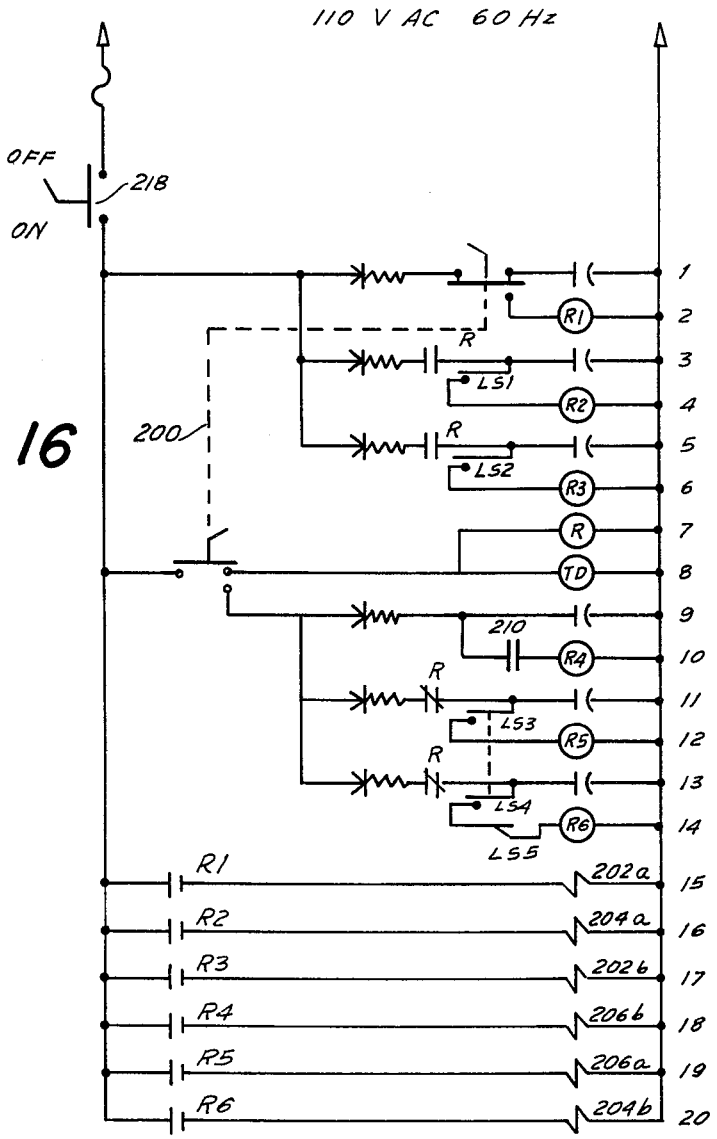
FIG. 16 is a schematic diagram of the control circuitry of the first preferred embodiment of the present invention.
Figure 17:
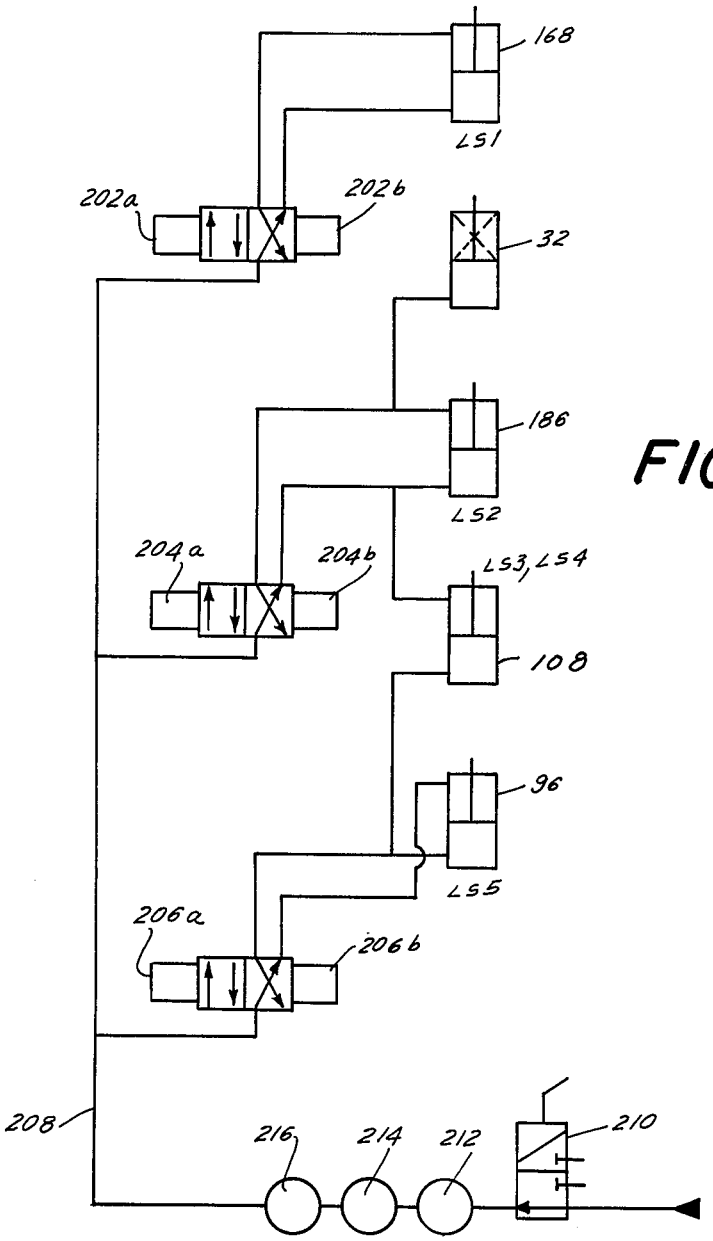
FIG. 17 is a schematic diagram of the pneumatic system of the present invention.

FIGS. 16 and 17 are, respectively, a schematic diagram of the electrical system and a schematic diagram of the pneumatic system which control the sequence of operations of the first preferred embodiment of the present invention. Assume that prior to beginning operation, the components are as illustrated in FIG. 15A, with carriage J, upon which the hook feed mechanism is mounted, in the "up" position spaced from the needle, hook feed mechanism L is in the "feed" position with a hook aligned with the axis of the needle, carriage E, upon which the tag feed mechanism is mounted, is in the "down" position such that a tag is on the needle and tag feed mechanism G is in the "reload" position.

Referring to FIG. 16, the parallel circuits are designated by the line (1 through 20) upon which same appears. Numeral 200 refers to a double pole, double throw footpedal switch having contacts on lines 1 and 8, such as Model AW14 available from the Square "D" Company. Seven relays, R, $R_1$, $R_2$, $R_3$, $R_4$, $R_5$ and $R_6$ are provided operably connected to contacts correspondingly labelled. The relay contacts control three double solenoid valves, labelled 202, 204 and 206. Each solenoid comprises two valves labelled a and b, respectively, one of which has pneumatic connections which are reversed with respect to the other in the pair, so as to move the piston therein in one of two selected directions.

As seen in FIG. 17, each of the solenoids 202, 204 and 206 is connected to a source of air under pressure (not shown) by means of an input conduit 208. The air from the source passes through a cut-off valve 210, a filter 212, a pressure regulator 214 and a lubricator 216, all of conventional design, prior to entering the solenoid air inputs. Each valve has two ports, an input port which is connected to conduit 208 and an exit port vented to the atmosphere.

Depression of ON-OFF switch 218 serves to energize the circuit of FIG. 16. The operator places the article between the needle, which already has a tag thereon (slide 130 being in the "reload" position and carriage E in the "down" position), and member 192 (slide 180) being in the "feed" position, a hook is already positioned in alignment with the needle, and then depresses the foot pedal 200. This energizes relay R (the contacts on lines 2 and 8 are closed when the pedal 200 is depressed), closing contacts R on lines 3 and 5, opening contacts R on lines 11 and 13, and energizing relay R1. Energizing relay R1 causes contacts R1 on line 15 to actuate valve 202*a* to cause cylinder 168 to move carriage J downwardly to force the article and a previously fed hook on the needle. This also closes normally opened limit switch LS1, located at the downward end of the path of movement of carriage J.

After LS1 is closed, indicating carriage J is in the "down" position, relay R2 is energized. This closes contacts R2 on line 16, actuating valve 204*a* to actuate cylinders 32 and 186. Actuation of cylinder 32 causes attacher B to be actuated to dispense a fastener. Actuation of cylinder 186 causes slide 180 to move to the "reload" position (left, as seen in FIG. 1) such that the next hook on the bottom of the stack is positioned on slide 180.

When slide 180 reaches the "reload" position, a limit switch LS2 located along the path of the slide is closed causing relay R3 to be energized. This closes contacts R3 on line 17, actuating valve 202*b* and, thus, cylinder 168 to move carriage J to the "up" position. This permits the operator to remove from the needle the article to which the tag and hook have been affixed. The operator then releases the footpedal 200.

Releasing footpedal 200 disconnects the contacts on lines 2 and 8 and connects the contacts on lines 1 and 9 and, thus, de-energizes relay R, closing normally closed contacts R on lines 11 and 13 and energizes time delay relay TD to begin the timing period. Since LS3, which is located along the path of slide 130, is closed because slide 130 is in the "reload" position, relay R5 is energized closing contacts R5 on line 19, actuating valve 20*a* and, thus, cylinder 96 to move carriage E to the "up" position and cylinder 108 to move slide 130 to the "feed" position.

Limit switch LS4 is positioned at the same location as LS3 and the contacts thereof are, therefore, also closed. When carriage E reaches the "up" position, normally closed limit switch LS5, located along the path of carriage E, the contacts of which are on line 14, is closed permitting relay R6 to be energized. LS5 prevents actuation of R6 unless carriage E is in the "up" position. This causes contacts R6 on line 20 to be closed actuavalve 204*b* and, thus, cylinders 108 and 186. Actuation of cylinder 108 causes slide 130 to move to the "reload" position so as to position a new tag on slide 130. Actuation of cylinder 186 causes slide 180 to move to the "feed" position.

It should be appreciated that the operator must remove the tagged article before carriage E again moves downwardly to place a new tag on the needle. Time relay TD permits the operator sufficient time to do this before the downward movement of carriage E can begin.

When the foot pedal 200 is released, time relay TD is energized and, after a preset time, closes switch contacts 210 on line 9. This energizes relay R4 closing contacts R4 on line 18 and actuating valve 206*b* and, thus, cylinder 96 to move carriage E down to place the tag on the needle. The process then repeats itself when the operator again presses the foot pedal.

While only two preferred embodiments of the present invention have been disclosed herein for purposes of illustration, it is obvious that many modifications and variations could be made thereto. It is intended to cover all of these variations and modifications which fall within the scope of the present invention, as defined by the following claims:

I claim:

1. Apparatus for automatically attaching one or more members to an article utilizing a fastener attacher of the type having a hollow needle, through which a fastener is dispensed when the attacher is actuated, said apparatus comprising a support, means for mounting the attacher to said support in a fixed position relative thereto, means for actuating the attacher and means for positioning a member on the needle, said positioning means comprising a carriage and means for moving said carriage relative to said support in a direction substantially parallel to the axis of the needle, said carriage comprising means for feeding a member from a first position, out of alignment with the needle, to a second position, in alignment with said needle, said carriage moving means moving said carriage between a position wherein said member is spaced from the needle and a position wherein said member is located on the needle, and means for actuating said member feeding means.

2. The apparatus of claim 1, further comprising a portion of said feeding means adapted to cooperate with said carriage so as to clamp the member to said carriage when the member is in said second position.

3. The apparatus of claim 2, further comprising means for positioning a second member over the needle.

4. The apparatus of claim 1, further comprising second means for positioning a second member over the needle.

5. Apparatus for automatically attaching first and second members to an article with a single fastener utilizing a fastener attacher of the type having a hollow needle, through which a fastener is dispensed when the attacher is actuated, said apparatus comprising a support, means for mounting the attacher to said support in a fixed position relative thereto, means for actuating the attacher, means for positioning a first member over the needle, and means for positioning a second member over the needle and means for actuating said means for positioning a first member and said means for positioning a second member, in sequence, prior to the actuation of the attacher.

6. The apparatus of claim 5, wherein said means for positioning a first member comprises a first carriage and means for moving said first carriage relative to said support in a direction substantially parallel to the axis of the needle, said first carriage moving means moving said first carriage between a position wherein said member is spaced from the needle and a position wherein said member is located on the needle.

7. The apparatus of claim 6, wherein said first carriage comprises means for feeding a first member from a first position, out of alignment with the needle, to a second position, in alignment with said needle, and means for actuating said first member feeding means.

8. The apparatus of claim 6, wherein said second member positioning means comprises a second carriage, means for moving said second carriage relative to said support, said second carriage comprising means for feeding a second member from a first position, out of alignment with the needle, to a second position, in alignment with said needle, and means for actuating said second member feeding means.

9. The apparatus of claim 8, wherein said second carriage further comprises an abutting member extending from said second carriage and having a recess therein, said recess being aligned with and adapted to receive therein at least a part of the needle.

10. The apparatus of claim 9, wherein said carriage is movable between a first position wherein said recess is remote from the needle and a second position wherein said needle is at least partially received within said recess.

11. The apparatus of claim 9, wherein said abutting member has a surface thereon and wherein said second member feeding means feeds said second member adjacent to said surface.

12. The apparatus of claim 9, wherein said second position of said second member is between said abutting member and the needle.

13. The apparatus of claim 10, wherein said second position of said second member is between said recess and said needle.

14. The apparatus of claim 12, wherein said second member has a hole therein and wherein said hole is aligned with said recess in said second position of said second member.

15. The apparatus of claim 13, further comprising means for energizing said second carriage moving means and means for energizing said second member feeding actuator means.

16. The apparatus of claim 15, further comprising control means for actuating said second member feeding actuator means energizing means to move a second member to said second member second position prior to the actuation of said second carriage moving means energizing means.

17. The apparatus of claim 8, wherein said second carriage moving means moves said second carriage in a direction substantially parallel to the axis of the needle.

18. The apparatus of claim 8, wherein said second member feeding means feeds said second member in a direction substantially perpendicular to the axis of the needle.

19. The apparatus of claim 7, wherein said first member feeding means moves the first member in a direction substantially perpendicular to the axis of the needle.

20. The apparatus of claim 8, wherein said second member feeding means moves the second member in a direction substantially perpendicular to the axis of the needle.

21. The apparatus of claim 8, further comprising means for energizing said attacher actuating means, means for energizing said second carriage moving means and means for energizing said second member feeding actuator means.

22. The apparatus of claim 21, further comprising control means for actuating said means for energizing said second member feeding actuator means to move said second member into alignment with the needle prior to the actuation of said attacher actuator energizing means.

23. The apparatus of claim 7, further comprising means for energizing said attacher actuating means, means for energizing said first carriage moving means and means for energizing said first member feeding actuator means.

24. The apparatus of claim 6, wherein said second member positioning means comprises a second carriage and means for moving said second carriage relative to said support, said second carriage comprising an abutting member mounted thereon having a recess therein, said recess being aligned with and adapted to receive therein at least a part of the needle.

25. The apparatus of claim 24, wherein said second carriage moving means moves said second carriage between a first position wherein said recess is remote from the needle and a second position wherein the needle is at least partially received in said recess.

26. The apparatus of claim 24, wherein said abutting member has a surface thereon and wherein the article is received between said surface and the needle.

27. The apparatus of claim 26, wherein said surface extends in a direction substantially perpendicular to the direction of second carriage movement.

28. The apparatus of claim 23, further comprising control means for actuating said means for energizing said first member feeding actuator means to move said first member into alignment with the needle prior to the actuation of said attacher actuator energizing means.

29. The apparatus of claim 23, further comprising control means for actuating said first carriage moving means energizing means to move said first member to said position on the needle prior to the actuation of said attacher actuator energizing means.

30. Apparatus for automatically attaching more than one member to an article with a single fastener utilizing a fastener attacher of the type having a hollow needle through which a fastener is dispensed when the attacher is actuated, said apparatus comprising a support, means for mounting the attacher to said support in a fixed position relative thereto, means for actuating said attacher, means for positioning first and second members on the needle in sequence, said positioning means comprising means for feeding a first member from a first position, out of alignment with the needle, to a second position, in alignment with the needle, means for feeding a second member from a first position, out of alignment with the needle, to a second position, in alignment with the needle, and means for moving each of said first member feeding means and said second member feeding means between a first position wherein said first and second members are spaced from the needle, and a second position wherein said first and second members are positioned on the needle.

31. The apparatus of claim 30, wherein said means for moving said first member feeding means and said second member feeding means comprises a first carriage to which said first member feeding means is mounted and a second carriage to which said second member feeding means is mounted.

32. The apparatus of claim 31, further comprising means for moving said first and second carriages relative to said support.

33. Apparatus for automatically attaching more than one member to an article with a single fastener utilizing a fastener attacher of the type having a hollow needle through which a fastener is dispensed when the attacher is actuated, said apparatus comprising a support, means for mounting the attacher to said support in a fixed position relative thereto, means for actuating said attacher and means for positioning first and second members on the needle in sequence.

34. The apparatus of claim 33, wherein said positioning means comprises means for feeding a first member from a first position, out of alignment with the needle, to a second position, in alignment with the needle.

35. The apparatus of claim 34, further comprising means for feeding a second member from a first position, out of alignment with the needle, to a second position, in alignment with the needle.

36. Apparatus for automatically attaching one or more members to an article utilizing a fastener attacher of the type having a hollow needle, through which a fastener is dispensed when the attacher is actuated, said apparatus comprising a support, means for mounting the attacher to said support in a fixed position relative thereto, means for actuating the attacher and means for positioning a first member on the needle, said first member positioning means comprising a first carriage and means for moving said first carriage relative to said support in a direction substantially parallel to the axis of the needle, said first carriage comprising means for feeding a first member from a first position, out of alignment with the needle, to a second position, in alignment with said needle, said first carriage moving means moving said first carriage between a first position wherein said member is spaced from the needle and a position wherein said first member is located on the needle, means for actuating said first member feeding means, a portion of said first member feeding means being adapted to cooperate with said first carriage so as to clamp the first member to said first carriage when the first member is in the second position, and further comprising a second carriage and means for moving said second carriage relative to said support, said second carriage comprising an abutting member mounted thereon having a recess therein, said recess being aligned with and adapted to receive therein at least a part of the needle.

37. Apparatus for automatically attaching one or more members to an article utilizing a fastener attacher of the type having a hollow needle, through which a fastener is dispensed when the attacher is actuated, said apparatus comprising a support, means for mounting the attacher to said support in a fixed position relative thereto, means for actuating the attacher and means for positioning a first member on the needle, said first member positioning means comprising a first carriage and means for moving said first carriage relative to said support in a direction substantially parallel to the axis of the needle, said first carriage comprising means for feeding a first member from a first position, out of alignment with the needle, to a second position, in alignment with said needle and means for actuating said first member feeding means, said first carriage moving means moving said first carriage between a position wherein said first member is spaced from the needle and a position wherein said first member is located on the needle, and means for positioning a second member over the needle, said second member positioning means comprising a second carriage, means for moving said second carriage relative to said support, said second carriage comprising means for feeding a second member from a first position, out of alignment with the needle, to a second position, in alignment with said needle, and means for actuating said second member feeding means.

38. The apparatus of claim 37, wherein said second carriage moving means moves said second carriage in a direction substantially parallel to the axis of the needle.

39. The apparatus of claim 37, wherein the second member feeding means feeds said second member in a direction substantially perpendicular to the axis of the needle.

40. The apparatus of claim 37, wherein said second carriage further comprises an abutting member extending from said second carriage and having a recess therein, said recess being aligned with and adapted to receive therein at least a part of the needle.

41. The apparatus of claim 40, wherein said second carriage is movable between a first position wherein said recess is remote from the needle and a second position wherein said needle is at least partially received within said recess.

42. The apparatus of claim 40, wherein said abutting member has a surface thereon and wherein said second member feeding means feeds said second member adjacent to said surface.

43. The apparatus of claim 40, wherein said second position of said second member is between said abutting member and the needle.

44. The apparatus of claim 41, wherein said second position of said second member is between said recess and said needle.

45. The apparatus of claim 43, wherein said second member has a hole therein and wherein said hole is aligned with said recess in said second position of said second member.

46. The apparatus of claim 44, further comprising means for energizing said second carriage moving means and means for energizing said second member feeding actuator means.

47. The apparatus of claim 46, further comprising control means for actuating said second member feeding actuator means energizing means to move a second member to said second member second position prior to the actuation of said second carriage moving means energizing means.

48. Apparatus for automatically attaching one or more members to an article utilizing a fastener attacher of the type having a hollow needle, through which a fastener is dispensed when the attacher is actuated, said apparatus comprising a support, means for mounting the attacher to said support in a fixed position relative thereto, means for actuating the attacher, and means for positioning a first member on the needle, said first member positioning means comprising a first carriage and means for moving said first carriage relative to said support in a direction substantially parallel to the axis of the needle, said first carriage comprising means for feeding a first member from a first position, out of alignment with the needle, to a second position, in alignment with said needle, said first carriage moving means moving said first carriage between a position wherein said first member is spaced from the needle and a position wherein said first member is located on the needle, means for actuating said first member feeding means, a second carriage and means for moving said second carriage relative to said support, said second carriage comprising an abutting member mounted thereon having a recess therein, said recess being aligned with and adapted to receive therein at least a part of the needle.

49. The apparatus of claim 48, further comprising means for energizing said attacher actuating means, means for energizing said first carriage moving means, and means for energizing said first member feeding actuator means.

50. The apparatus of claim 49, further comprising control means for actuating said means for energizing said first member feeding actuator means to move said first member into alignment with the needle prior to the actuation of said attacher actuator energizing means.

51. The apparatus of claim 48, wherein said second carriage moving means moves said second carriage between a first position wherein said recess is remote from the needle and a second position wherein the needle is at least partially received in said recess.

52. The apparatus of claim 48, wherein said abutting member has a surface thereon and wherein the article is received between said surface and the needle.

53. The apparatus of claim 52, wherein said surface extends in a direction substantially perpendicular to the direction of second carriage movement.

54. The apparatus of claim 49, further comprising control means for actuating said first carriage moving means energizing means to move said first member to a position on the needle prior to the actuation of said attacher actuator energizing means.

55. The apparatus of claim 48, wherein said first member feeding means moves the first member in a direction substantially perpendicular to the axis of the needle.

* * * * *